US005316199A

United States Patent [19]

Hansen et al.

[11] Patent Number: 5,316,199

[45] Date of Patent: May 31, 1994

[54] ADJUSTABLE ANGLE BAR ASSEMBLY FOR A PRINTING PRESS

[75] Inventors: Robert E. Hansen, Clarendon Hills; H. L. Carlson, Chicago, both of Ill.

[73] Assignee: Rockwell International Corporation, El Segundo, Calif.

[21] Appl. No.: 947,320

[22] Filed: Sep. 18, 1992

[51] Int. Cl.[5] ..... B65H 23/32

[52] U.S. Cl. ..... 226/197; 226/199; 226/194

[58] Field of Search ..... 226/196, 197, 199, 97, 226/194

[56] References Cited

U.S. PATENT DOCUMENTS

| | | | |
|---|---|---|---|
| 2,989,265 | 6/1961 | Selsted | 226/97 X |
| 3,290,795 | 12/1966 | Jarreby | 226/97 X |
| 3,599,851 | 8/1971 | Hedlund et al. | 226/197 X |
| 3,623,645 | 11/1971 | Klingler | 226/199 X |
| 3,679,116 | 7/1972 | Hamlin et al. | 226/197 |
| 3,954,213 | 5/1976 | Andersen | 226/197 X |
| 4,043,495 | 8/1977 | Sander | 226/197 |
| 4,197,002 | 8/1980 | Hamaker et al. | 226/97 X |
| 4,453,465 | 6/1984 | Heller et al. | 226/197 X |
| 4,532,864 | 8/1985 | Heller et al. | 226/197 X |

FOREIGN PATENT DOCUMENTS

| | | | |
|---|---|---|---|
| 0280782 | 11/1927 | United Kingdom | 226/197 |

*Primary Examiner*—Daniel P. Stodola
*Assistant Examiner*—Paul Bowen
*Attorney, Agent, or Firm*—C. B. Patti; H. F. Hamann

[57] ABSTRACT

An adjustable angle bar assembly (10) for a printing press (12) having a support (14), a hollow angle bar (18) pivotally mounted adjacent a longitudinal central portion (34) of the angle bar (18) to the support (14), with the angle bar (18) having a cavity (20) for the passage of air, and a plurality of openings 30 extending through the angle bar (18) and communicating with the cavity (20) for passage of air through the angle bar (18) from the cavity (20) to a web (32) passing over the angle bar (18), and a device for passing the air into the central portion (34) of the angle bar (18) for distribution of the air by the angle bar (18) against the web (32) irrespective of the orientation of the angle bar with respect to said support (14).

8 Claims, 4 Drawing Sheets

ADJUSTABLE ANGLE BAR ASSEMBLY FOR A PRINTING PRESS

BACKGROUND OF THE INVENTION

The present invention relates to angle bar assemblies for a printing press.

In the past, printing presses have been provided with angle bars for directing or changing the path or motion of a paper web in the press. Such angle or turning bars have been provided with aperture through which air passes to cause some flotation of the web relative to the angle bar as the web passes around the angle bar.

However, in the past, the air has been supplied through an end of the angle bar which has made it relatively difficult to change the direction of the angle bar relative to the press, since the source of air to the angle bar must also be changed. A web guiding system for a printing press has been provided by U.S. Pat. No. 5,100,117, which did not adequately solve the problem of directing air in a proper manner through the angle bar when the direction of the angle bar is changed.

SUMMARY OF THE INVENTION

A principal feature of the present invention is the provision of an improved angle bar assembly of simplified construction.

The angle bar assembly of the present invention comprises, a support, a hollow angle bar pivotally mounted adjacent a longitudinal central portion of the angle bar to the support, with the angle bar having a cavity for the passage of air, and a plurality of openings extending through the angle bar and communicating with the cavity for passage of air through the angle bar from the cavity to a web passing over the angle bar.

A feature of the invention is the provision of means for passing the air into the central portion of the angle bar for distribution of the air by the angle bar against the web.

Another feature of the invention is that the air is supplied to the angle bar irrespective of the orientation of the angle bar with respect to the support.

Thus, a feature of the invention is that the angle bar eliminates the necessity to reposition the source of air to the angle bar when the orientation of the angle bar is changed.

Still another feature of the invention is that the angle bar may be moved to first and second rotatable positions approximately 90 degrees apart, such that the angle bar is adjustable, without changing the connection of the air to the angle bar.

Yet another feature of the invention is that the angle bar may be selectively locked at a desired position of the angle bar.

Another feature of the invention is that the angle bar is rotatably mounted to the support by a pivot pin which is hollow to pass air from the support to the angle bar.

Further features will become more fully apparent in the following description of the embodiments of this invention, and from the appended claims.

DESCRIPTION OF THE PREFERRED EMBODIMENTS

Figure 1:
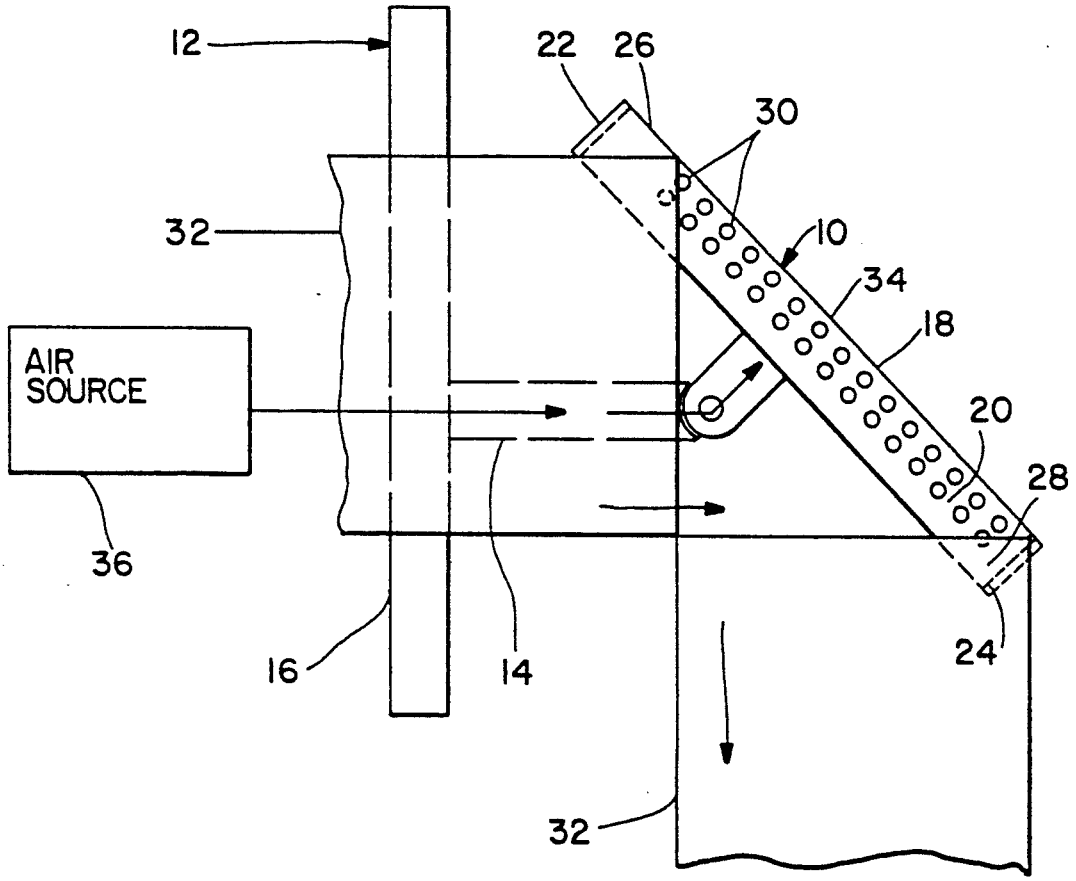
FIG. 1 is a diagrammatic plan view of an angle bar assembly for directing a web in a printing press.
Figure 2:
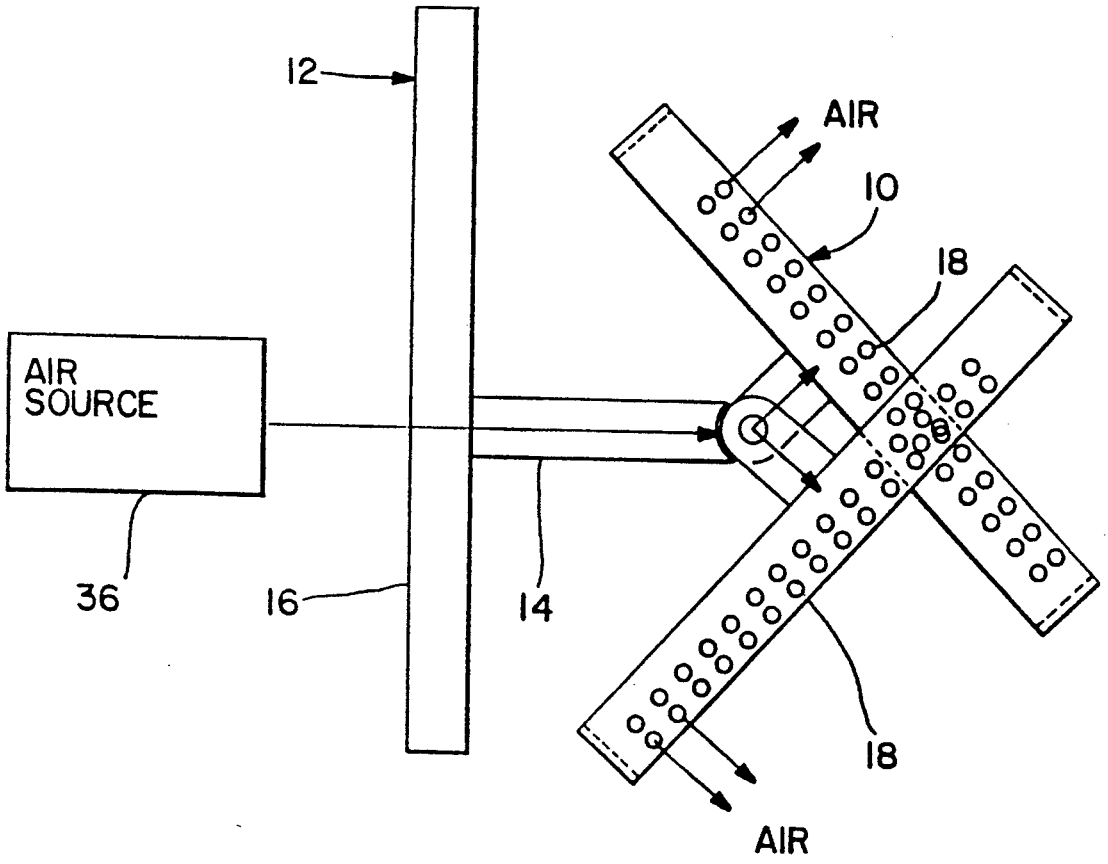
FIG. 2 is a diagrammatic plan view of the angle bar assembly of FIG. 1, with an angle bar of the assembly being in different configurations.

Referring now to FIGS. 1 and 2, there is shown an angle bar assembly generally designated 10 for a printing press generally designated 12. The angle bar assembly 10 has bracket 14 comprising a support, extending from a plate or wall 16 comprising a frame of the press 12. The angle bar assembly 10 has an elongated hollow angle bar or turning bar 18 having a cavity 20 and a pair of caps 22 and 24 closing the opposed ends 26 and 28 of the angle bar 18. The angle bar 18 has a plurality of apertures 30 extending through the angle bar 18 and communicating between the cavity 20 and the atmosphere in order to permit passage of air from the cavity 20 against a paper web 32 passing over the angle bar 18 to provide a cushion by the air for the web 32 as it passes over the angle bar 18.

As shown, the angle bar 18 is pivotally mounted to the bracket 14, such that the angle bar 18 may be rotatably moved between first and second separate positions approximately 90 degrees apart, as shown in FIG. 2. As will be seen below, the air passes through a longitudinal central portion 34 of the angle bar 18 from a source of air 36 without the necessity of changing the air connection to the angle bar assembly 10 when the bar 18 is moved to different positions. Although the invention will be described in connection with the use of air, it will be understood that any other suitable gas may be used, and the term air will be construed to include such gas.

Figure 3:
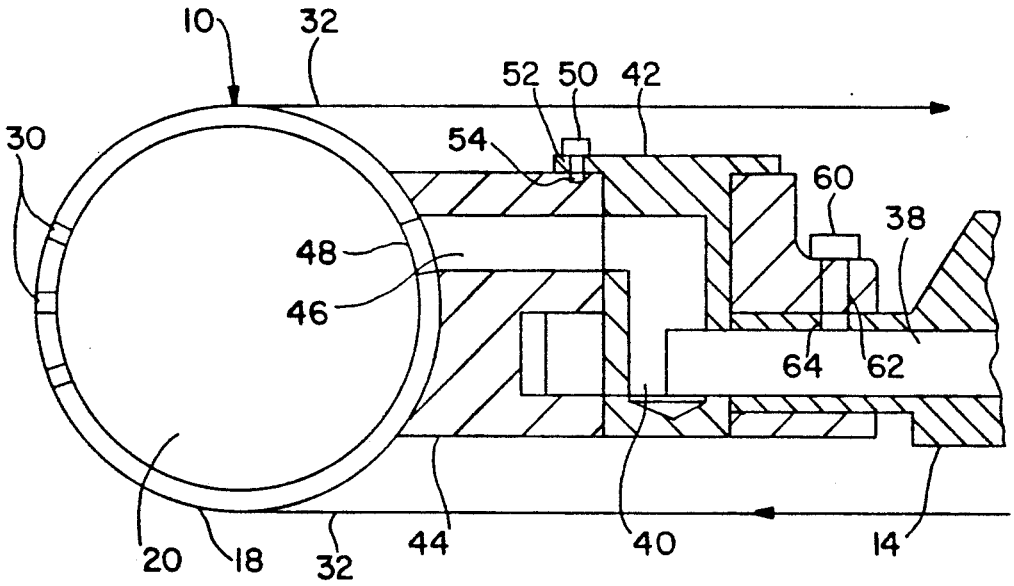
FIG. 3 is a fragmentary sectional view of the angle bar assembly of the present invention.
Figure 4:
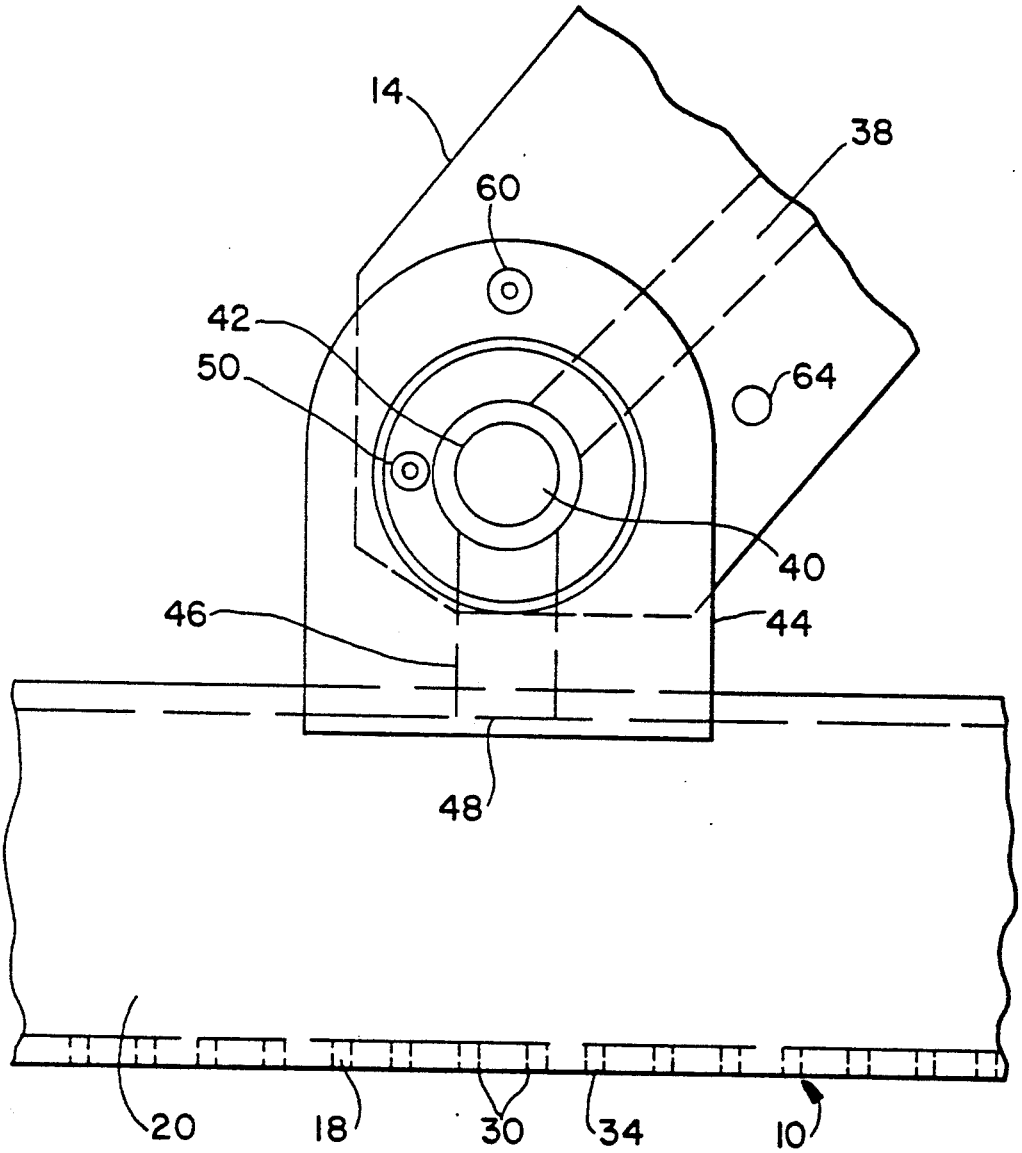
FIG. 4 is a fragmentary plan view of the angle bar assembly of the present invention.

With reference to FIGS. 3 and 4, the bracket 14 of the angle bar assembly 10 has a bore 38 extending through the bracket 14 which communicates with an internal bore 40 of a pivot pin 42, such that communication is established between the bore 38 of the bracket 14 and the bore 40 of the pin 42 irrespective of the position of the angle bar 18. As shown, the angle bar 18 has a connection member 44 pivotally mounted on the pin 42, such that the pin 42 and angle bar 18, including the connection member 44, rotate relative to the bracket 14. The connection member 44 has an internal passage 46 communicating between the bore 40 of the pivot pin bore 40 and the cavity 20 of the angle bar 18 through an opening 48 in the wall of the angle bar 18. In this manner, communication is established between the bore 38 of the bracket 14 and the cavity 20 of the angle bar 18 irrespective of the rotational position of the angle bar 18 relative to the bracket 14 in order to pass the air through the apertures 30 extending along the angle bar 18 and cushion the web 32 as it passes over the angle bar 18.

The angle bar assembly 10 has a locking pin 50 which passes through an opening 52 of the pivot pin 42 to a preformed opening 54 in the connection member 44 of the angle bar 18. In this manner, the locking pin 50 prevents movement between the pivot pin 42 and the connection member 44 in order to maintain the bore 40 and passage 46 in communication.

Thus, in accordance with the present invention, the angle bar assembly 10 has an angle bar 18 which may be moved to selected position while supplying air to the angle bar without the necessity of repositioning the air supply each time the angle bar is moved to a different position.

The assembly 10 also has a second locking pin 60 received in a bore 62 of the connection member 44 into one of a plurality of bores 64 in the bracket 14 in order to releasably lock the angle bar 18 at a desired rotational position. The pin 60 may be withdrawn from the bore 64 of the bracket 14, and the angle bar 18 may be rotated to a new position, such as 90 degrees from the first position, and the pin 60 may be inserted in another bore 64 in order to releasably lock the angle bar 18 at the new position.

The foregoing detailed description has been given for clearness of understanding only, and no unnecessary limitations should be understood therefrom, as modifications will be obvious to those skilled in the art.

We claim:

1. An adjustable angle bar assembly for a printing press, comprising:

a support;

a hollow angle bar having a pair of opposed portions and a central portion spaced inwardly from the end portions of the bar, with the central portion of said angle bar being pivotally mounted to the support, said angle bar having a cavity for the passage of air, and a plurality of openings extending through the angle bar and communicating with the cavity for passage of air through the angle bar from the cavity to a web passing over the angle bar; and means for passing the air into the central portion of the angle bar for distribution of the air by the angle bar against the web irrespective of the orientation of the angle bar with respect to said support, wherein the support comprises a bracket supporting the angle bar in the central portion of the bar, with the angle bar being pivotally supported on the bracket;

wherein the bracket has a bore extending through the bracket, and in which the air passes through the bore to the central portion of the bar.

2. The bar assembly of claim 1 wherein the support includes a frame of the press.

3. The bar assembly of claim 1 including a hollow pivot pin pivotally mounting the bar to the bracket, and having a bore in communication with the cavity of the bar and the bore in the bracket, such that the pin passes the air from the bracket to the bar irrespective of the orientation of the bar.

4. The bar assembly of claim 1 wherein the bar is rotatable between first and second positions spaced approximately 90 degrees apart.

5. The bar assembly of claim 1 including means for locking the bar at a selected position.

6. An adjustable angle bar assembly for a printing press, comprising:

a hollow bracket having a bore;

a hollow angle bar having a cavity and a plurality of apertures extending through the bar and communicating between the cavity and the atmosphere;

a hollow pivot pin pivotally mounting a generally longitudinal central portion of the angle bar to the bracket for movement of the angle bar between first and second different rotatable positions relative to the bracket, and having a bore in communication with the bore of the bracket and the cavity of the angle bar, such that air passes through the bore of the bracket, through the bore of the pivot pin, and into the cavity of the angle bar for passage of the air through said apertures to a web passing over the angle bar; and means for passing air into the bore of the bracket for distribution through the apertures of the angle bar to the web.

7. The bar assembly of claim 6 including means for locking the angle bar at a selected position relative to the bracket.

8. The bar assembly of claim 6 wherein the angle bar is movable between positions approximately 90 degrees apart as the bar is rotated relative to the bracket.

* * * * *